US007922022B2

(12) United States Patent
Ciarrocchi, Jr.

(10) Patent No.: US 7,922,022 B2
(45) Date of Patent: Apr. 12, 2011

(54) HANGING CONDIMENT CONTAINER HOLDER

(75) Inventor: Peter Ciarrocchi, Jr., Bensalem, PA (US)

(73) Assignee: CPC Properties, Inc., Wilmington, DE (US)

( * ) Notice: Subject to any disclaimer, the term of this patent is extended or adjusted under 35 U.S.C. 154(b) by 804 days.

(21) Appl. No.: 11/751,872

(22) Filed: May 22, 2007

(65) Prior Publication Data

US 2008/0290089 A1 Nov. 27, 2008

(51) Int. Cl.
*A47G 19/00* (2006.01)
*B65D 21/02* (2006.01)

(52) U.S. Cl. ..... 220/23.4; 220/23.83; 248/311.2

(58) Field of Classification Search ..... 220/23.4, 220/23.83, 737, 751; 229/120.13, 120.18; 248/311.2; 224/926
See application file for complete search history.

(56) References Cited

U.S. PATENT DOCUMENTS

| | | | | |
|---|---|---|---|---|
| 3,442,435 | A | 5/1969 | Ludder et al. | |
| 3,490,726 | A * | 1/1970 | Mills | 248/313 |
| 3,926,361 | A | 12/1975 | Hilderbrand | |
| 4,491,220 | A | 1/1985 | Daviss | |
| 4,620,631 | A | 11/1986 | Bartelt | |
| 4,685,583 | A | 8/1987 | Noon | |
| 4,732,274 | A | 3/1988 | Bouton | |
| 4,765,581 | A * | 8/1988 | Wallace et al. | 248/311.2 |
| 4,854,466 | A | 8/1989 | Lane, Jr. | |
| 4,938,373 | A | 7/1990 | McKee | |
| 4,955,528 | A | 9/1990 | Schluckebier | |
| 5,429,262 | A | 7/1995 | Sharkey | |
| 5,540,333 | A | 7/1996 | Gonzalez et al. | |
| 5,613,720 | A | 3/1997 | Shaddy | |
| 5,626,283 | A | 5/1997 | Mellon | |
| 6,152,362 | A | 11/2000 | Rosenfeld | |
| 6,193,201 | B1 | 2/2001 | Babcock | |
| 6,230,969 | B1 | 5/2001 | Spransy | |
| D452,149 | S | 12/2001 | Nance | |
| D454,764 | S | 3/2002 | Moore | |
| D454,785 | S | 3/2002 | Nance | |
| 6,364,112 | B1 | 4/2002 | Pitschka | |
| 6,386,443 | B1 | 5/2002 | Szczerbinski | |
| D466,013 | S | 11/2002 | Nance | |
| D466,407 | S | 12/2002 | Nance | |
| 6,755,305 | B2 | 6/2004 | Nance | |
| 2002/0134781 | A1 | 9/2002 | Ciarrocchi, Jr. | |
| 2007/0205199 | A1 | 9/2007 | Wothers | |
| 2007/0241105 | A1 * | 10/2007 | Nielsen | 220/23.4 |

OTHER PUBLICATIONS

Hanging Hook Shot Glasses, http://www.flashingpromos.com/custom_glassware_hookshot.htm (printout from Apr. 28, 2010).
Hanging Shot Glass Search Results, http://www.alibaba.com/showroom/hanging-shot-glass.html (printout from Apr. 28, 2010).
1.5 oz hanging Shotglass—Imprinted, http://www.tooters.com/1-5-oz-custom-printed-plastic-hooked-shot-glass-p/3201.htm (printout from Apr. 28, 2010).

* cited by examiner

*Primary Examiner* — Anthony Stashick
*Assistant Examiner* — Harry A Grosso
(74) *Attorney, Agent, or Firm* — Volpe and Koenig, PC

(57) ABSTRACT

A hanging condiment container holder is provided including a clip portion for removably attaching the holder to an upper portion of a food package, a loop portion for receiving a condiment container, and an extension wall extending between the clip portion and the loop portion. The clip portion may be contoured to the shape of the upper edge or lip of a food package such as a cup. Various clip portions may be employed for removably attaching the hanging condiment container holder to a food package such as a cup.

10 Claims, 12 Drawing Sheets

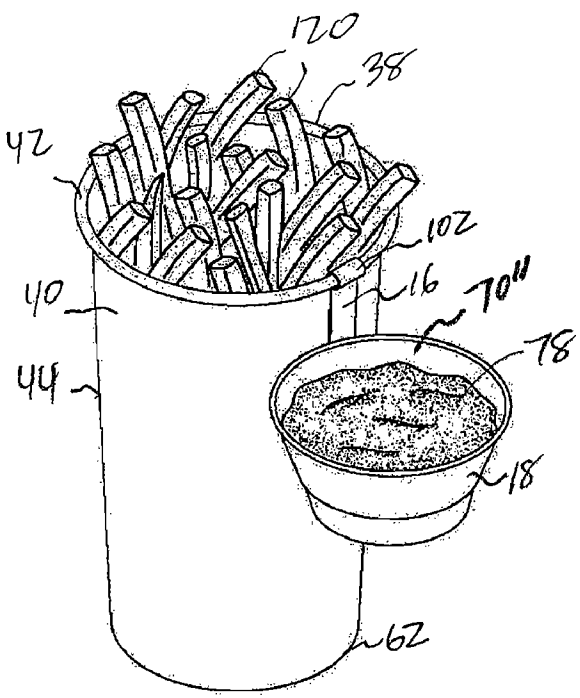
FIG. 13
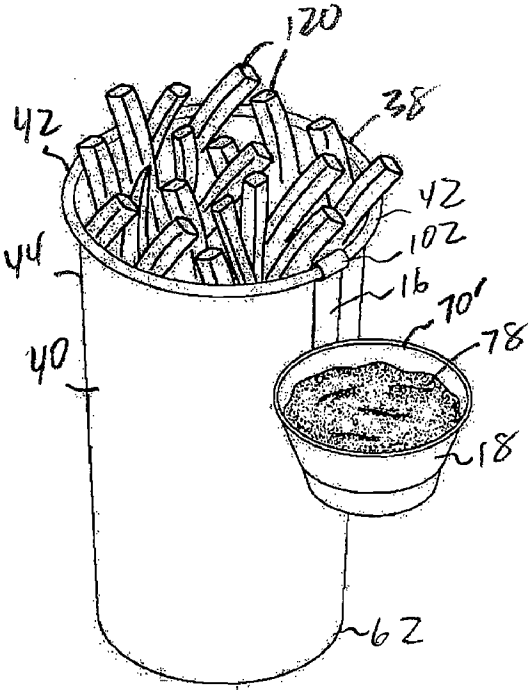
FIG. 14
FIG. 15

HANGING CONDIMENT CONTAINER HOLDER

FIELD OF INVENTION

The present invention relates to the field of holders for condiment containers, and to food packages having holders for condiment containers.

BACKGROUND

Snack foods, for example french fries, nacho chips, or pretzel nuggets, are often eaten along with condiments including ketchup, dipping sauce, ranch dressing, melted cheese, and the like. Such snack foods are often enjoyed at sporting events, arenas or concerts. In those environments, a person has a cramped space in which to enjoy their snack food and, thus, eating can at times be difficult. In addition, people at sporting events, arenas or concerts often have both hands occupied, perhaps holding a beverage in one hand, and their snack food of choice in the other. Even at a local bar, pub or tavern, there is often limited space in which to enjoy a food item.

Foods such as snack foods are often served in a food container cup for convenient and economic reasons. Rather than smother an entire portion of food in a dipping sauce or condiment such as ketchup, most people prefer to dip a snack food into ketchup or other dipping sauce, thus regulating the amount of ketchup or other dipping sauce to suit their personal preference. However, when a cup or similar container is used to dispense the snack food, as is the case at, for example, arenas, a person must apply the ketchup or other dipping sauce directly to the top layer of snack food. This results in the top layer of snack food being immersed in ketchup or dipping sauce, and the lower layers of snack food completely devoid of any of the desired ketchup or dipping sauce. In addition, a person must inevitably dip their fingers into the ketchup or dipping sauce in order to take the snack food from the top layer.

Food packages have been preformed with flaps or pockets to hold condiments. Such food packages consist of complicated arrangements, and must be manufactured so that the condiment container is a permanent part of the food package. In addition, such food packages cannot be adjusted or moved by a person eating the food.

Other known condiment containers are essentially small troughs. These troughs do not accommodate the shape of known condiment cups. Soufflé cups are often used by establishments such as restaurant as condiment holders, or for dispending condiments from bulk containers or pumps. For example, soufflé cups sold under the brand name SOLO® are generally cylindrical or frustoconical, as shown in the examples of FIGS. 8-9, 13-15. These cups come in various industry standard sizes, such as 1½ oz (44.4 ml), 2 oz (59.1 ml), 2½ oz (73.9 ml), 3¼ oz (96.1 ml), 4 oz (118.3 ml), and 5½ oz (162.7 ml). Other known pleated soufflé cups are offered under the brand name SWEETHEART®, are cylindrical or frustoconical, and are offered in various sizes. The known trough condiment holders cannot readily accommodate these industry standard soufflé cups.

Still other known condiment holders are suspended directly from the sides of food packages. These arrangements are awkward and unbalanced. In addition, these know arrangements cannot be firmly attached to food packages, and can result in spills.

Yet other condiment holders are positioned adjacent the upper lip of a cup or food package. This creates an awkward and unbalanced arrangement, which can also easily result in spills. For example, a thick dipping sauce, such as melted cheese, could easily topple the food container to which the condiment cup is attached. This is more likely as a person consumes the contents of the food container, whereby the food container cup will become lighter and topple more easily. In addition, there is very little support for the condiment cup, as the attachment means must carry the weight of the condiment cup, plus the weight of the ketchup or dipping sauce in the condiment cup.

Thus, there is the need for a condiment holder that can be used in connection with any commercially available food container or cup.

There is also the need for a condiment holder that can be secured firmly to a food container, without having to specially manufacture food containers for receiving such a condiment holder.

There is even further the need for a condiment holder that attaches to a food holder such as a cup that provides for a sturdy arrangement with less potential for spilling the condiment or tipping the food holder.

There is even further the need for a condiment holder that accommodates known, industry standard soufflé cups.

The present invention satisfies these needs.

SUMMARY

A hanging condiment container holder according to the present invention includes a clip portion for removably attaching the holder to an upper portion of a food package, a loop portion for receiving a condiment container, and an extension wall extending between the clip portion and the loop portion. The clip portion may be contoured to the shape of the upper edge or lip of a food package such as a cup. Various clip portions may be employed for removably attaching the hanging condiment container holder to a food package such as a cup.

BRIEF DESCRIPTION OF THE DRAWINGS

For the purpose of illustrating the invention, there is shown in the drawings various forms that are presently preferred, it being understood, however, that this invention is not limited to the precise arrangements and constructions shown.

FIG. 13 is an isometric view of a hanging condiment container holder according to FIG. 1 or 2 of the present invention of a first exemplary size suspended from a food container with a condiment container inserted into the hanging condiment container holder.

FIG. 14 is an isometric view of a hanging condiment container holder according to the present invention of a second exemplary size suspended from a food container with a condiment container inserted into the hanging condiment container holder.

FIG. 15 is an isometric view of a hanging condiment container holder according to the present invention of a third exemplary size suspended from a food container with a condiment container inserted into the hanging condiment container holder.

DETAILED DESCRIPTION OF THE PREFERRED EMBODIMENTS

Figure 2:
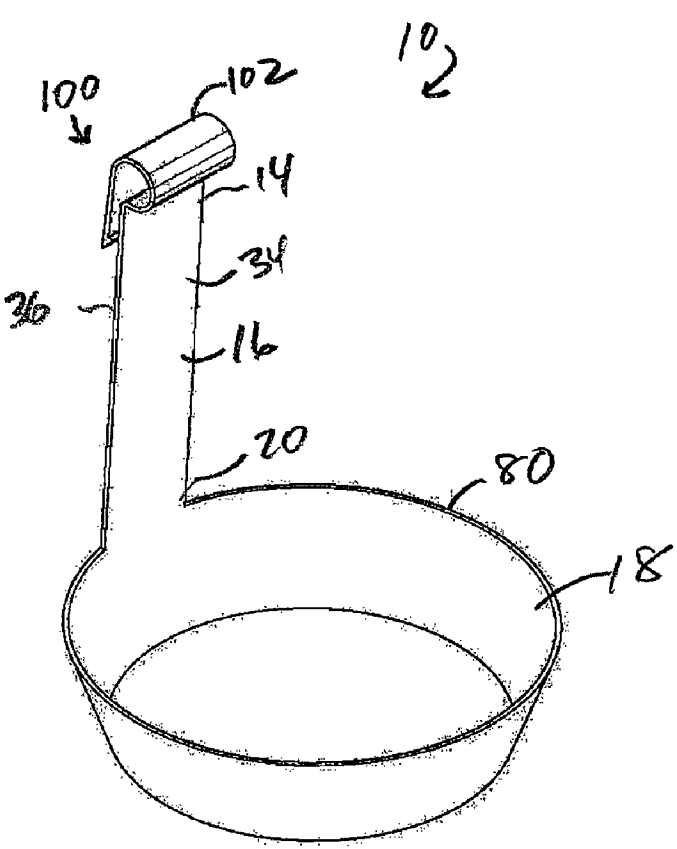
FIG. 2 is an isometric view of an alternate embodiment of a hanging condiment container holder according to the present invention.

Certain terminology is used herein for convenience only and is not to be taken as a limitation on the invention. Particularly, words such as "upper," "lower," "left," "right," "horizontal," "vertical," "outer", "inner", "upward," and "downward" merely describe the configuration shown in the figures. The phrase "are any or all of the following: "A", "B" or "C" shall mean that any of the preceding elements; A, B or C may be present individually, or in any combination; i.e., A and B only, A, B, and C, B and C only, etc.

As used herein, the term "soufflé cup" or "condiment container" refers to a frustoconical cup having a generally circular horizontal cross section and an open upper portion for receiving a condiment (for example ketchup, mustard, salsa, dressing, dipping sauce, melted cheese, etc.), such as those shown in FIGS. 5, 12, and 13-15, and sold under the brand names SOLO® and SWEETHEART®, which are well known in the art.

FIGS. 1, 3-9 show a first embodiment of a hanging condiment container holder 10 according to the present invention including an anchor or clip portion 100 adjacent its upper end 14, an extension wall 16 extending downwardly from the upper end 14, and a loop portion 18 adjacent the lower end 20 of the holder 10. The holder 10 is preferably formed from plastic, but may be formed from any light, flexible material such as a metal, synthetic rubber, silicone, or other materials, or combinations of such materials. The extension wall 16 includes a first surface 34 and a second surface 36. In use (when the holder 10 is hanging on the outer part of a cup or food package), the first surface 34 will face away from a cup or food package (also referred to as a food holder), and the second surface 36 will face toward the cup or food package. A cup is but one example of a food package.

Figure 1:
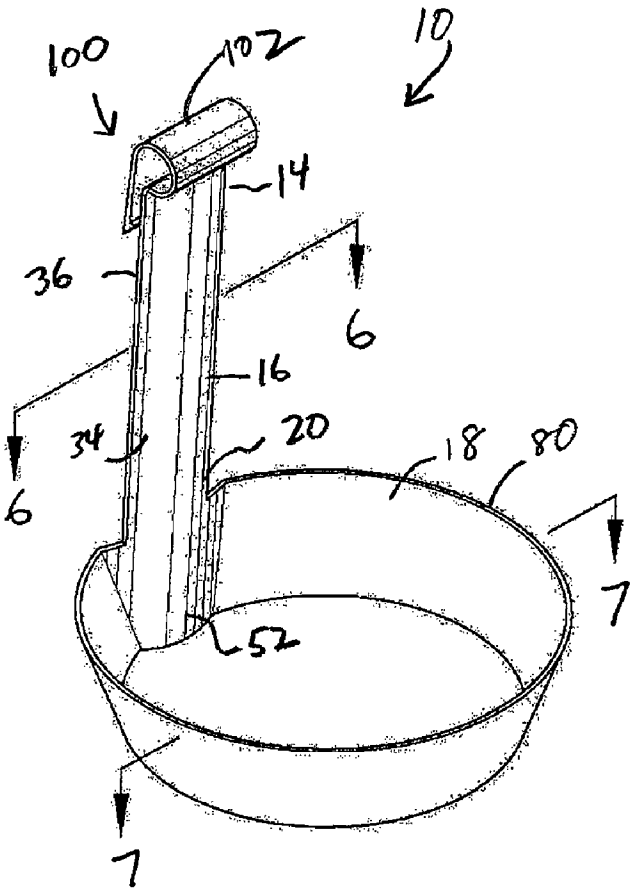
FIG. 1 is an isometric view of a hanging condiment container holder according to an embodiment of the present invention.
Figure 6:
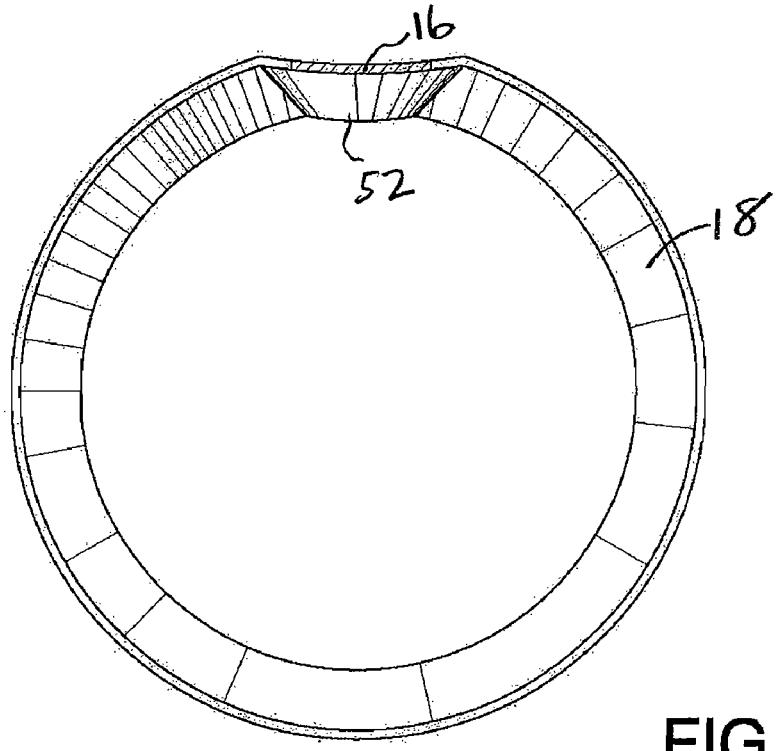
FIG. 6 is a cross section view from the top of the hanging condiment holder of the present invention shown in FIG. 1 taken along line 6-6.
Figure 7:
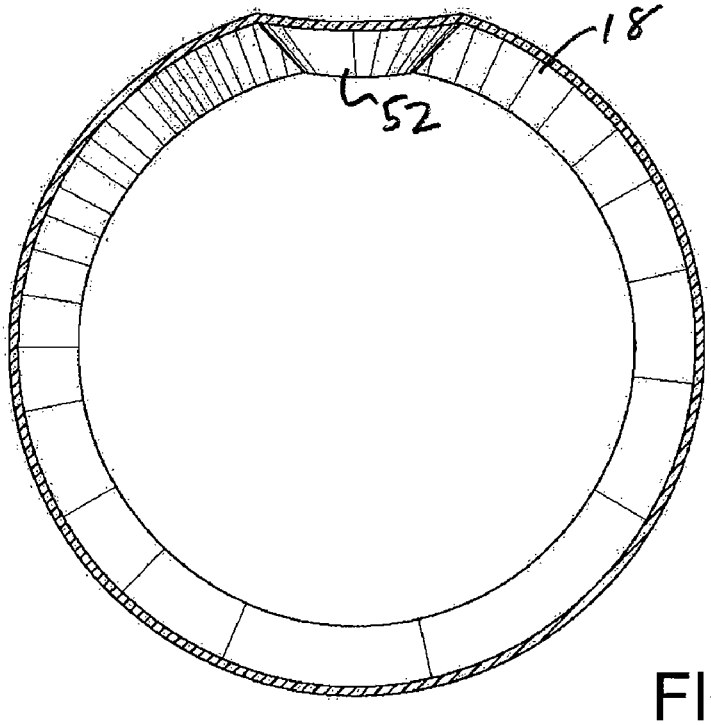
FIG. 7 is a cross section view from the top of the hanging condiment holder of the present invention shown in FIG. 1 taken along line 7-7.

The loop portion 18 is formed as an open generally frustoconical annular wall defining an opening, as shown in FIGS. 1 and 2. The loop portion 18 is formed to correspond to the shape of the wall 82 of a condiment container 70, as shown in FIGS. 1, 6-7. The loop may be any size for accommodating, for example, the various sized industry standard soufflé cups. An inwardly curving portion 52 of the loop portion 18 may be formed to curve in an opposite direction, tracing the shape of the wall 44 of a cup 42, as shown in detail in FIGS. 6-7. The loop portion 18 may also be formed at least in part from a flexible material such as a rubber or elastic and sized slightly smaller than a first diameter of a condiment container, so that when a condiment holder is placed in the loop portion 18, the loop portion 18 stretches to accommodate the condiment container and firmly grip the condiment container. The loop portion 18 may be formed having any length, and is preferably approximately about half the length of the wall of a condiment container 70, as shown in FIG. 5.

As shown in FIGS. 1, and 6-9, the extension wall 16 is preferably formed having an axial cross section that is shaped to conform to the outer curvature of the wall 44 a food container such as a cup 40. In addition, as mentioned, an inwardly curving portion 52 of the loop portion 18 may similarly be preferably formed having an axial cross section that is shaped to conform to the outer curvature of the wall 44 of a food container such as a cup 40 (shown holding french fries 120 as a food example), as shown in FIG. 7. The cup 40 has an inner side 55 and an outer side 57, and the holder 10 of the present invention is designed so that the loop portion 18 is positioned adjacent the outer side 57 of the cup 40.

Figure 9:
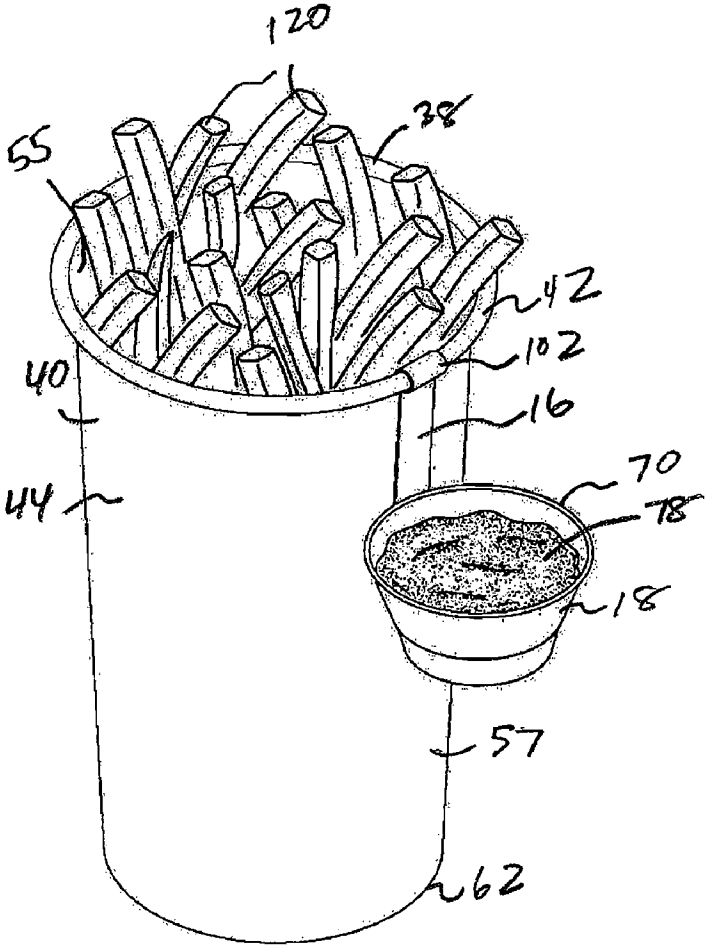
FIG. 9 is an isometric view of a hanging condiment container holder according to FIG. 1 or 2 suspended from the upper portion of a food container with a condiment container inserted into the hanging condiment container holder.
Figure 8:
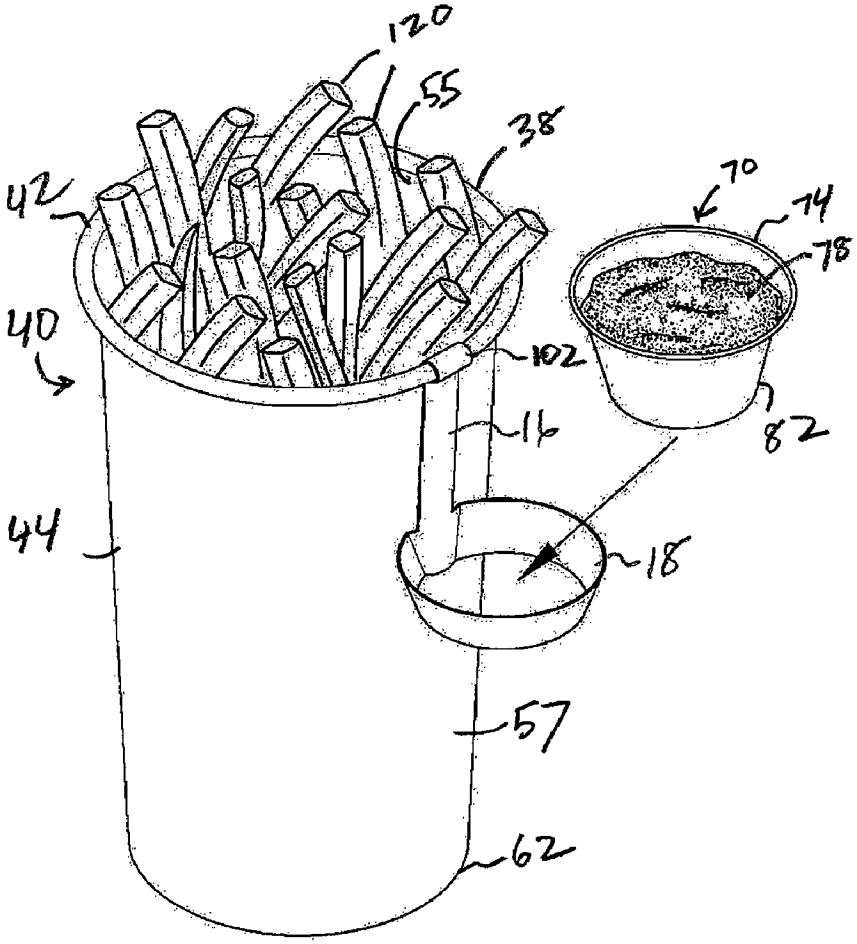
FIG. 8 is an isometric view of a hanging condiment container holder according to FIG. 1 or 2 suspended from the upper portion of a food container, and a condiment container to be inserted into the hanging condiment container holder.

The clip portion 100 may also be formed with a curved shaped (curved axial cross section) to conform to the curve if the rounded upper lip 42 of a food container such as a cup 40, as shown in FIGS. 8-9. According to this arrangement, the holder 10 will rest substantially flush against the cup wall 44 as shown in FIGS. 4-5, 8-9, when the holder 10 is attached to the lip 42 of a cup 42 as described in greater detail below. This arrangement provides for a condiment container holder that is more likely to stay in place when attached to and suspended from a food container such as a cup than known devices, as the corresponding curve or contour of the cup wall 44 and the curved wall of the extension 16 and/or the loop portion 18 and/or clip portion 100 provide for surfaces that are complementary. These complementary surfaces will act to prevent the holder 10 from sliding when the holder 10 is secured to a food container or package such as a cup 42, as shown in FIGS. 8-9, 13-15. Alternately, as shown in FIG. 2, the extension wall 16 and loop portion 18 may be formed substantially non-contoured or flat, for use with a food package having a generally flat package wall.

Figure 3:
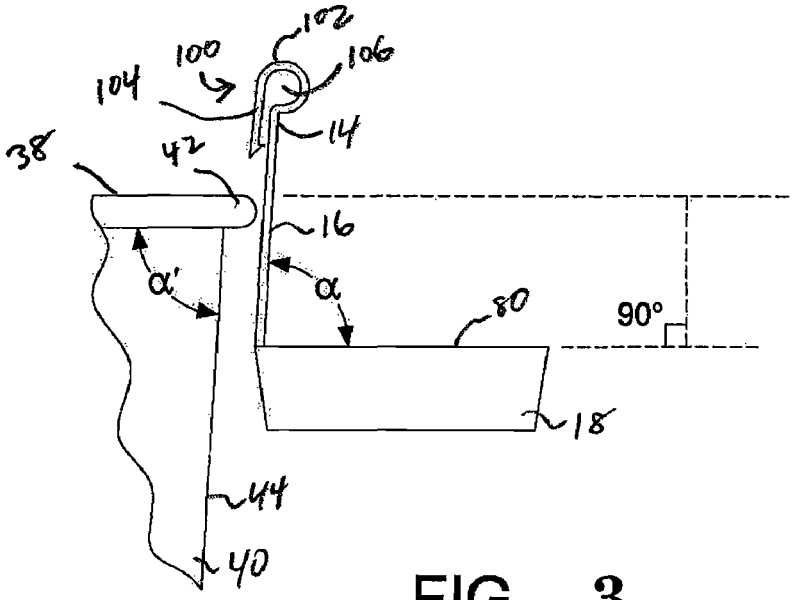
FIG. 3 is a side view of a hanging condiment holder according to an embodiment of the present invention of FIG. 1 or 2 in relation to a food package.
Figure 4:
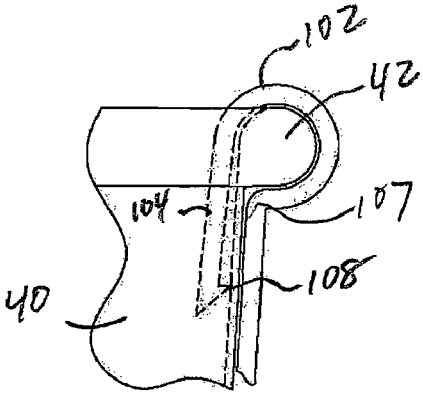
FIG. 4 is a close up of the clip portion of the hanging condiment holder shown in FIG. 3 attached to the lip of a food package.
Figure 5:
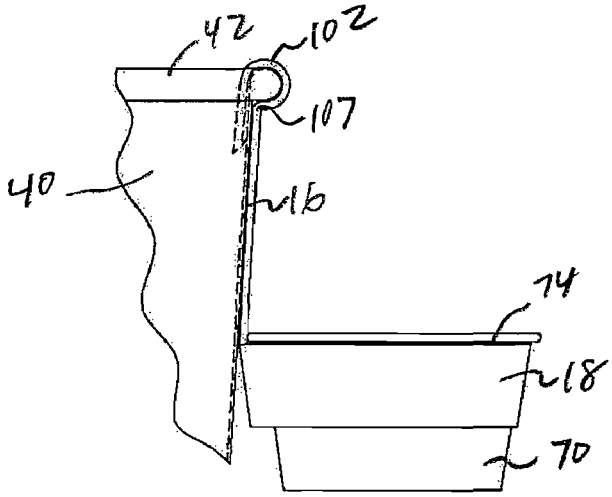
FIG. 5 is a side view of the hanging condiment holder according to the present invention shown in FIG. 3 attached to the upper portion of a food container with a condiment container inserted into the hanging condiment holder.

The clip portion 100 preferably includes a rounded lip engaging portion 102, as shown in FIGS. 1-15, that terminates in an inner cup extension 104 that is positioned opposite the extension wall 16, as shown in FIGS. 1-5. The clip portion 100 defines an opening 106 for receiving the lip 42 of a cup 40 as shown in detail in FIGS. 4-5. The rounded lip engaging portion 102 is formed having a contour that is complementary to the shape of a cup lip 42 in order to securely grip the lip 42 of a cup 40 holding a food such as french fries 120 shown in FIGS. 8-9, 13-15. The lip 42 fits securely within the opening 106 when the holder 10 is attached to the cup 40, as shown in FIGS. 4-5. A portion 107 of the rounded lip engaging portion 102 is positioned adjacent the lower side of the cup lip 42, as shown in FIGS. 4-5, to assist in anchoring the holder 10 to the cup 40. The inner cup extension 104 may include a flange 108 or other extension or protrusion providing for an additional gripping surface to secure the holder 10 to the cup 40 and to assist in preventing the holder 10 from moving during use.

Many cups 40 for holding food products such as french fries 120 have inwardly sloping walls which have a largest diameter adjacent the upper edge 38 of the cup 40, and decrease in diameter at the lower end 62 of the cup 40. The inwardly sloping cup wall 44 is disposed at an angle $\alpha'$ relative to the substantially horizontal upper edge 38 of the cup 40. For use with such a cup 40 having a sloped wall, the extension wall 16 and loop portion 18 may be disposed relative to each other at an angle $\alpha$, which is substantially equal to the angle $\alpha'$, as shown in FIGS. 3-5. According to this arrangement, when the holder 10 is attached to the cup 40, the extension wall 16 will rest against the cup wall 44, and the loop portion 18 will be positioned substantially horizontally and generally parallel with the upper edge 38 of the cup 40, as shown in FIG. 3. When condiment container 70 is inserted into the loop portion 18, as shown in FIG. 5, the condiment container 64 and loop portion 18 are positioned so that the condiment inside the condiment container 64 will sit generally horizontal and the condiment 78 (such as ketchup or a dipping sauce) will be less likely to spill during use.

Figure 12:
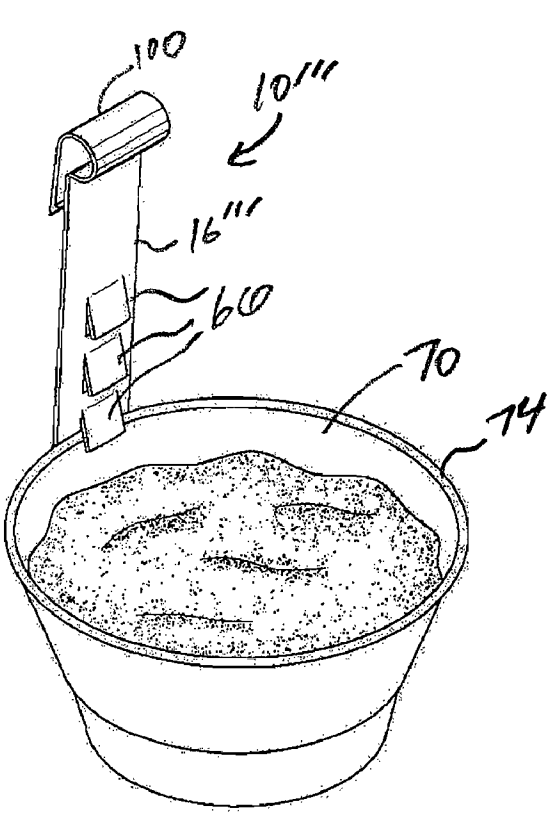
FIG. 12 is an isometric view of an alternate embodiment of a hanging condiment container holder according to the present invention with a plurality of condiment container securing tabs, with a condiment container inserted into the hanging condiment container holder.
Figure 11:
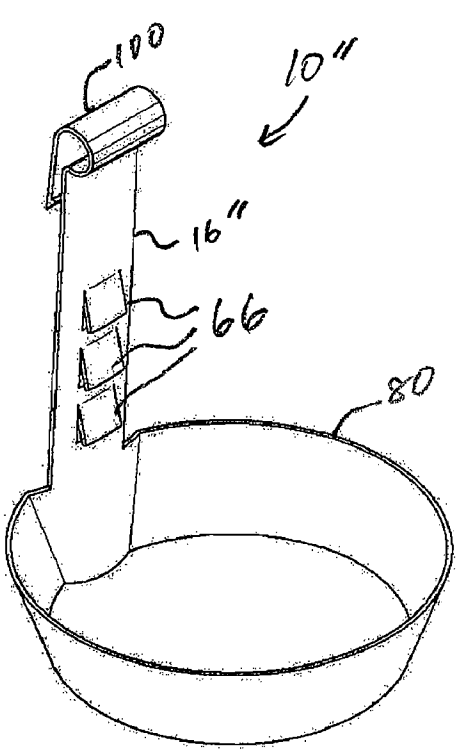
FIG. 11 is an isometric view of an alternate embodiment of a hanging condiment container holder according to the present invention with a plurality of condiment container securing tabs.
Figure 10:
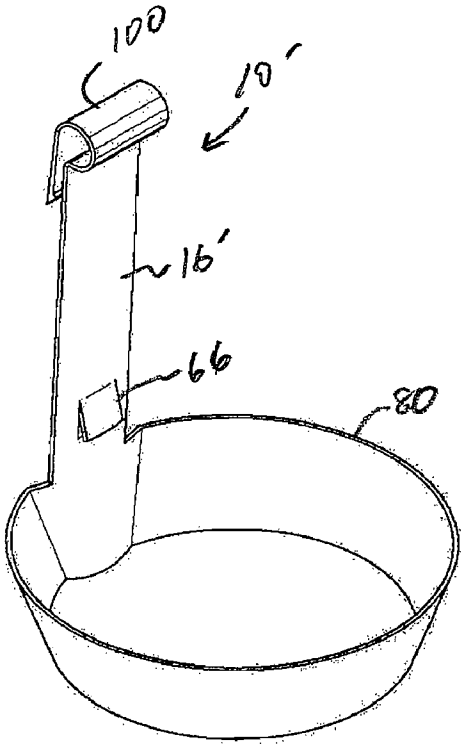
FIG. 10 is an isometric view of an alternate embodiment of a hanging condiment container holder according to the present invention with a condiment container securing tab.

In an alternate embodiments 10', 10", 10'", as shown in FIGS. 10-12, the extension wall 16', 16", 16'" may be provided with at least one or a plurality of retaining tabs 66. These retaining tabs 66 assist in holding a condiment container 70, such as a soufflé cup, in the loop portion 18 of the holder 10 when the condiment container 70 is inserted into in the loop portion 18, as shown in FIG. 15. Generally, condiment containers 70 such as soufflé cups include an opening 76 for receiving a condiment 78 within the condiment container 70. The condiment containers 70 have an annular lip 74 extending from the upper portion 72 of the condiment container 70. When the condiment container is placed in the loop portion 18 of the condiment holder of the present invention, the lip 74 will rest against the upper end 80 of the loop portion 18.

The retaining tabs 66 shown in FIGS. 10-12 are provided as flexible extensions of the extension wall 16 that extend from the first surface 34 of the extension wall 16 and act to clip the condiment container 70 in place. The retaining tabs 66 preferably include openings 68 that face downwardly. The retaining tabs 66 are positioned along the first surface 34 of the extension wall 16 corresponding to the position of the upper portion 72 of the condiment container 70 when the condiment container 70 is placed in the loop portion, as shown in FIG. 12. The upper portion 72 of the condiment container 70 will snappingly engage the corresponding retaining tab 66 when positioned within the loop portion 18, as shown in FIG. 12. As condiment containers 70, 70', 70" such as soufflé cups come in different sizes, such as shown in FIGS. 13-15, a plurality of retaining tabs 66 can be provided corresponding to the variously size soufflé cups.

The holder 10 of the present invention is designed to be suspended from the upper edge 38 of a food package such as a cup 40, as shown in FIGS. 8-9, and will hang on the outer side 57 of the cup 40. In this manner, when a condiment container 70 with a condiment 78 is placed in the loop portion 18, the condiment 78 is separate from any food item such as french fries 120 placed in the cup 40. In this manner, a user can regulate the desired amount of condiment 78 on the food item 120. In addition, this keeps the condiment 78 separate from the food item 120 prior to a user's desire to dip the food item 120 in the condiment 78. Moreover, in this arrangement, the condiment container 70 and condiment 78 are positioned in manner so that they will not interfere with the food item 120 placed in the cup 40, or otherwise block a user from retrieving the food item 120 from the cup 40.

When the holder 10 of the present invention is attached to a food package such as a cup 40, as shown in FIGS. 8-9, the extension wall 16 extends along a selected length of the cup wall 44, with the loop portion 18 positioned away from the upper edge 38 of the cup 40, so that when a condiment container 70 is placed in the loop 18 of the holder 10, the condiment container 70 and any condiment 78 within the condiment container 70 are not directly adjacent the upper edge 38 of the cup 40. In this manner, the holder 10 of the present invention does not interfere with a user who attempting to remove a food item 120 from the cup 40. If the condiment container 70 is positioned directly adjacent or too close to the upper edge 38 of the cup 40, a user could, for example, accidentally placed their hands or fingers in the condiment, ruining the user's experience. In addition, if the condiment container 70 is positioned directly adjacent to or too close to the upper edge 38 of the cup 40, a user could inadvertently tip the holder 10 or the condiment container 70 positioned in the loop portion 18, spilling the contents of the condiment container 70. The present invention provides for an arrangement that avoids these mishaps, by positioning the loop portion 18 away from the upper edge 38 of the cup 40. Preferably, the extension wall 16 is at least one inch in length, although the extension wall 16 can be any length where a condiment container 70 placed in the loop portion 18 will not block or interfere with a user reaching for a food item 120 in the cup 40.

Figure 18:
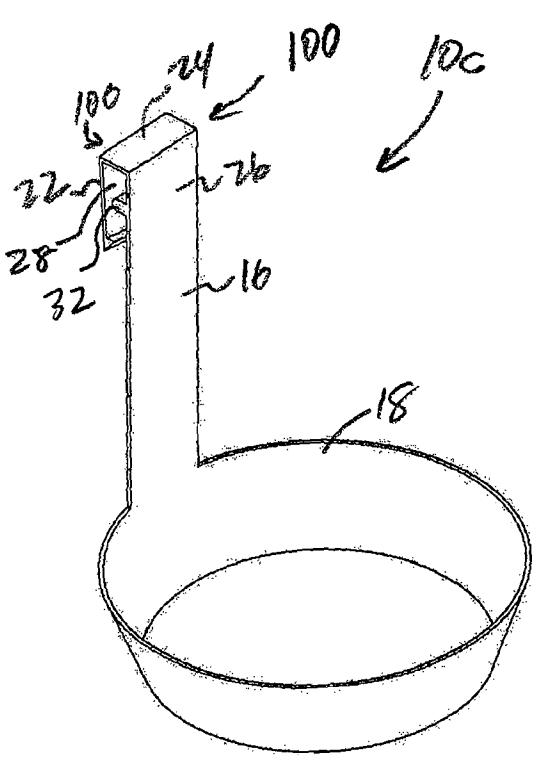
FIG. 18 is an isometric view of a hanging condiment container holder according to an alternate embodiment of the present invention.
Figure 17:
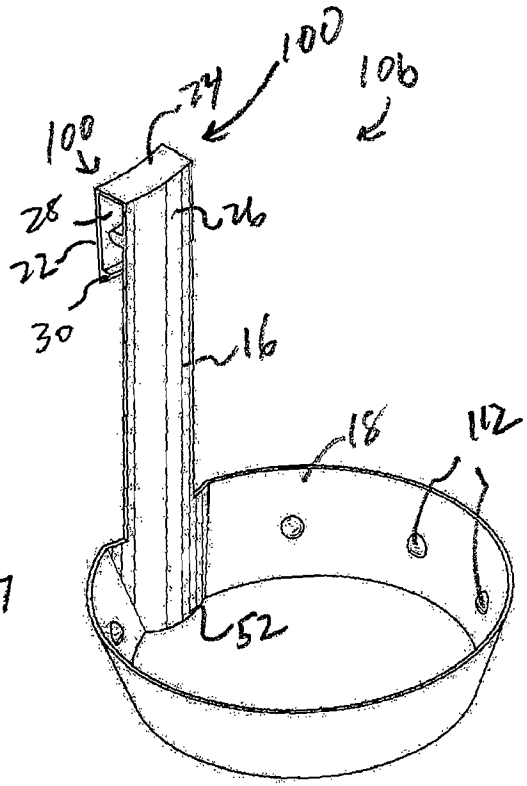
FIG. 17 is an isometric view of a hanging condiment container holder according to an alternate embodiment of the present invention including gripping studs.
Figure 16:
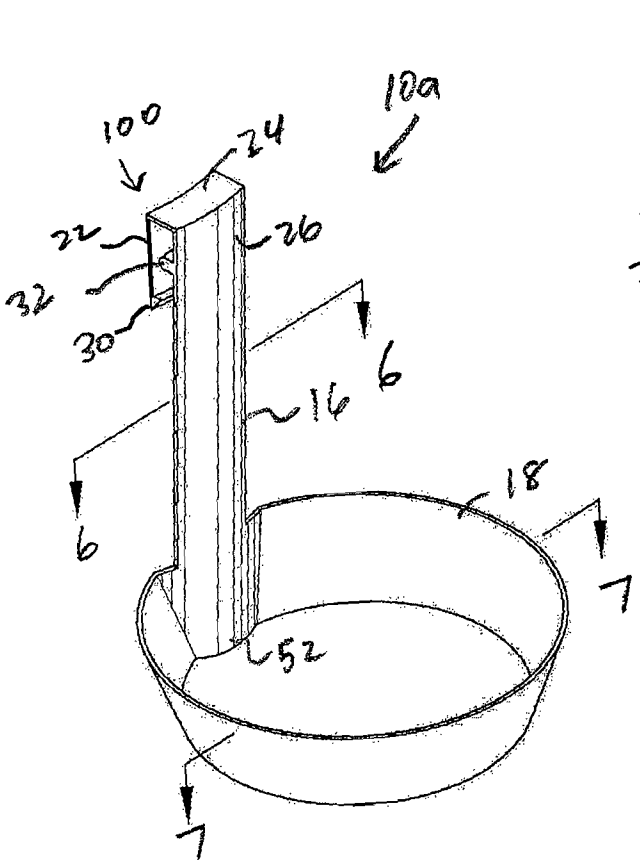
FIG. 16 is an isometric view of a hanging condiment container holder according to an alternate embodiment of the present invention.

The clip portion of hanging condiment container holder according to the present invention may be provided as any fastener arrangement adapted for attaching the holder 10 to the upper lip of a cup or food package. For example, as shown in FIGS. 16-18 (showing several alternate embodiments of the hanging condiment holder 10*a*, 10*b*, and 10*c*), the clip portion 100 may include a clip wall 22 positioned opposite an upper portion 26 of the extension wall 16, and a transverse wall 24 connecting the clip wall 22 adjacent the upper end 14. The transverse wall 24 may be substantially straight, or may be provided with a curve or contour to conform to the surface of a food package to which the holder 10 is being attached, as shown in FIGS. 16-17. The clip wall 22, transverse wall 24 and upper portion 26 define an opening 28 for receiving the upper edge 38 or lip of a cup 40 or other food package. Preferably, the food package is a cup 40 has an extending peripheral upper lip 42 providing an attachment surface 54.

Figure 24:
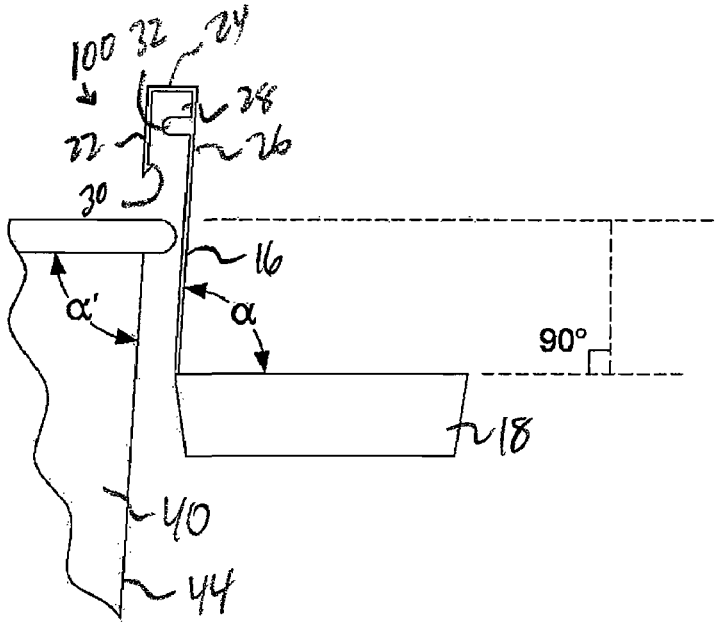
FIG. 24 is a side view of the hanging condiment holder according to the present invention shown in FIG. 18 in relation to the upper portion of a food container to which it will be attached.
Figure 25:
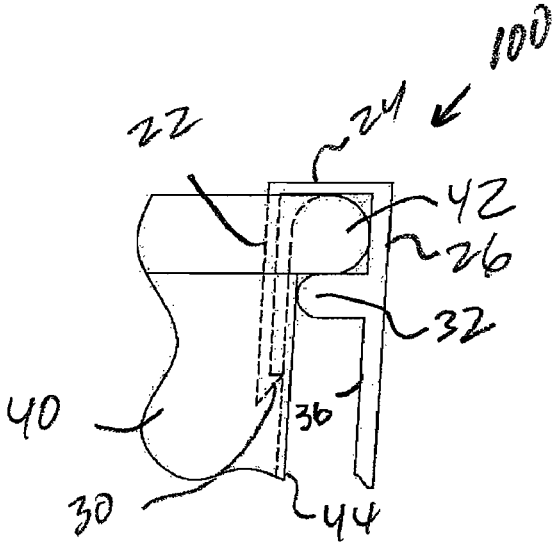
FIG. 25 is a close-up view of an embodiment of the clip portion of a hanging condiment holder according to the present invention attached to the upper portion of a food container.
Figure 26:
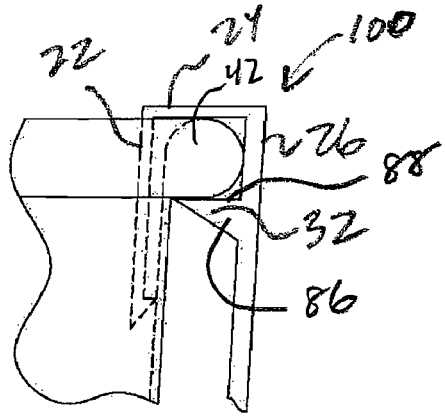
FIG. 26 is a close-up view of an alternate embodiment of the clip portion of a hanging condiment holder according to the present invention attached to the upper portion of a food container.

The clip portion 100 may further comprise at least one first flange 30 extending from the clip wall 22 toward the opening 28, and at least one second flange 32 extending from the second surface 36 of the extension wall 16. As the clip portion 100 is preferably formed from a flexible material such as a plastic, the clip portion 100 provides snapping engagement when affixing the holder 10 to an upper edge 38 of a cup 40, as shown in FIGS. 24-26. The opening 28 is preferably sized to be approximately slightly larger than the combined width of the cup wall 44 and cup lip 42, as shown in FIG. 25. The distance between the first flange 30 and the second flange 32 is preferably smaller than the combined width of the cup 40 and cup lip 42, and is approximately about the same distance as the width of the cup wall 44, as shown in FIGS. 25 and 26. The flanges 30, 32 act to assist in maintaining the holder 10 on a food package having a lip portion at its upper edge.

As shown in detail in FIGS. 24-26, preferably, when the holder 10 is attached to the lip 42 of a cup 40, the second flange 32 will rest beneath the lip 42, securing the lip 42 within the space 28. The flanges 30, 32 may be of any shape or design adapted to secure the holder 10 to a cup 40. FIGS. 16-18, 24-25 show the flange 32 of the clip portion 100 as a generally rounded or oblong protrusion. In addition, the clip portion 101 may be formed with flange 32 formed as a generally triangular protrusion 86, as shown in FIG. 26, with a flat surface 88 positioned facing the lower portion of the cup lip 42.

Figure 27:
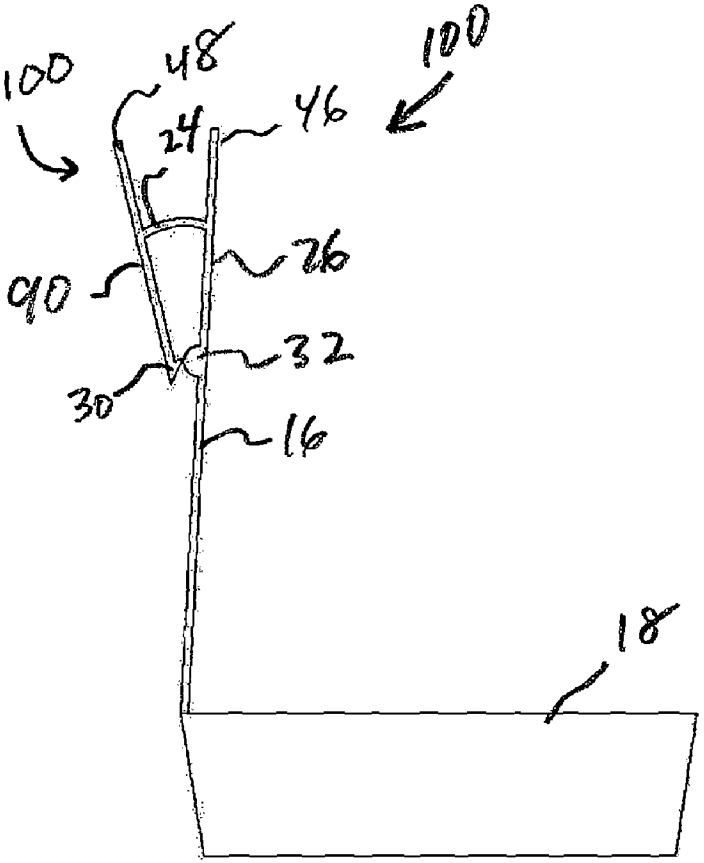
FIG. 27 is an alternate embodiment of a hanging condiment holder according to the present invention.

In another embodiment, shown in FIG. 27, the clip portion 100 may be formed including an opposing clip wall 90 that is angled toward the upper portion 26 of the extension wall 16. The first flange 30 and the second flange 32 may touch as shown in FIG. 27. A first grip tab 46 is provided as an extension adjacent the upper portion 26 of the extension wall 16. A second grip tab 48 is provided as an extension of the clip wall 90. In this embodiment, the transverse wall 24 is molded or otherwise formed to act as an elastic biasing element, where the first flange 30 of the clip wall 90 is biased toward second flange 32 of the upper portion 26 of the extension wall 16. In use, a user presses the grip tabs 46, 48 toward each other, moving the first flange 30 away from the second flange 32. The clip portion 100 is then inserted over the upper edge 38 or lip 42 of a cup 40 or other food package. When the user releases the grip tabs 46, 48, the transverse wall 24 will return to its original position, biasing the first flange 30 of the clip wall 90 is biased toward second flange 32, and clipping or fastening the holder 10 securely to the upper edge 38 of the cup 40 about the lip 42.

Figure 28:
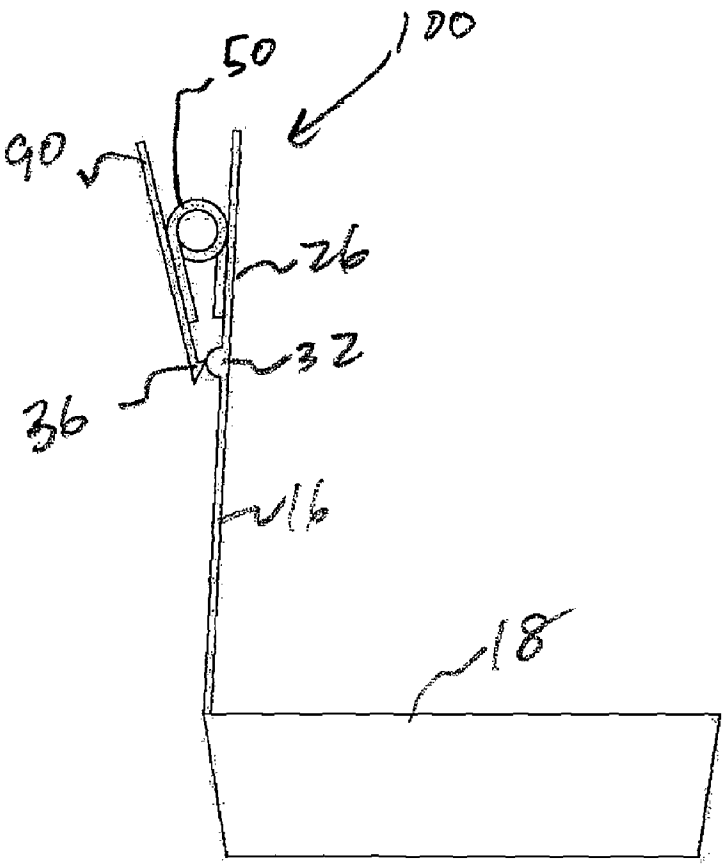
FIG. 28 is an alternate embodiment of a hanging condiment holder according to the present invention.

In another embodiment of the clip portion 100 as shown in FIG. 28, a spring 50 or other biasing element such as piece of rubber, foam, or other flexible member, is provided attaching the clip wall 90 to the upper portion 26 of the extension wall 16, as shown in FIG. 28. In the first position, shown in FIG. 28, the clip wall 90 is angled, so that the first flange 30 is positioned proximate the second flange 32. The upper portion of the clip wall 90 and the upper portion 14 of the extension wall 16 form grip tabs 46, 48. In use, a user presses the grip tabs 46, 48 toward each other, moving the first flange 30 away from the second flange 32. The clip portion 100 is then inserted over the upper edge 38 of a cup 40 or other food package. When the user releases the grip tabs 46, 48, the spring 50 will return to its original position, biasing the first flange 30 of the clip wall 90 toward second flange 32, and securely fastening the holder 10 to the upper edge 38 of the cup 40.

Figure 30:
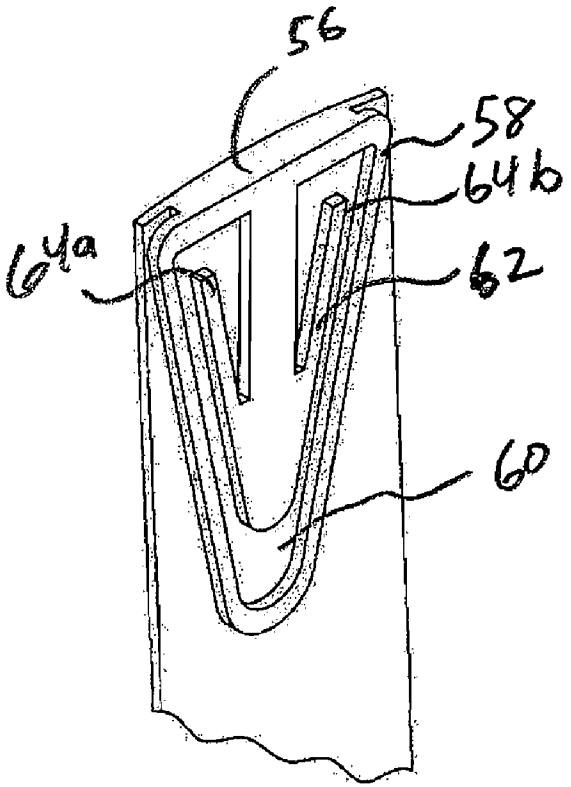
FIG. 30 is a close-up view of the clip portion of the hanging condiment holder shown in FIG. 29.
Figure 29:
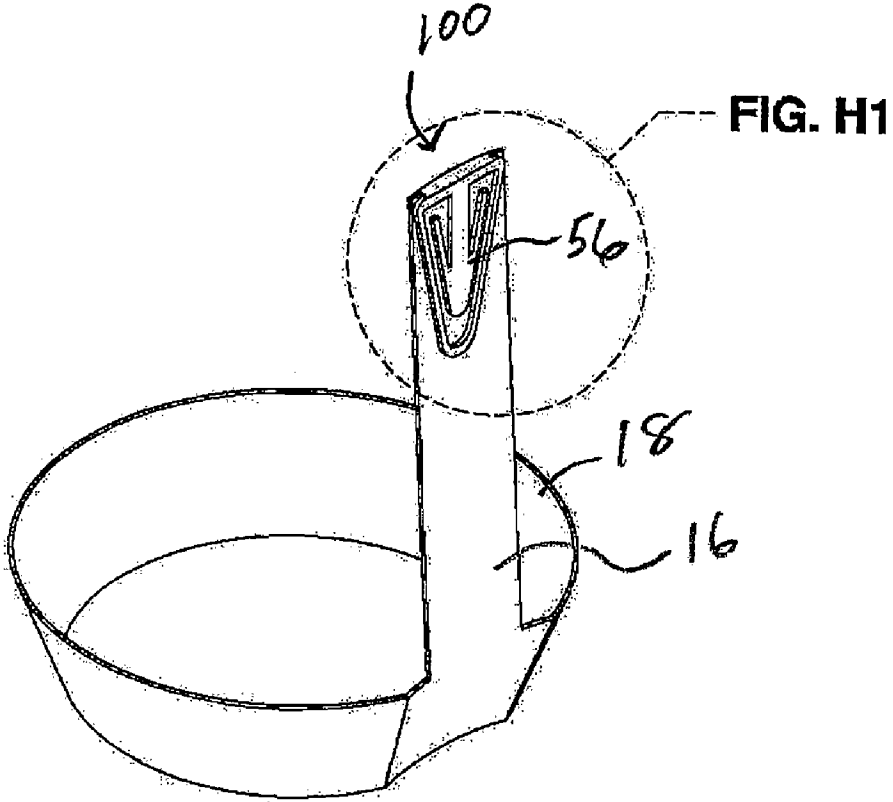
FIG. 29 is an alternate embodiment of a hanging condiment holder according to the present invention.

In yet another embodiment, the clip portion 100 is formed as a plastic fastener 56 extending adjacent the second surface 36 of the upper portion 14 of the extension wall 16, as shown in FIGS. 29-30. The plastic fastener 56 includes an outer arrow-shaped portion 58 defining an arrow-shaped opening 60, and an inner generally arrow-shaped shaped portion 62 extending into the opening 60. The inner portion 62 includes flanges 64*a*, 64*b*. The plastic fastener 56 may be hooked about the lip 42 of a cup 40, with the outer portion 58 adjacent the inner surface of the cup wall 44, and the inner portion 62 adjacent the outer surface of the cup wall 44. In this arrangement, the flanges 64*a*, 64*b* will snappingly engage the cup lip 42, securing the holder 10 in place.

Figure 21:
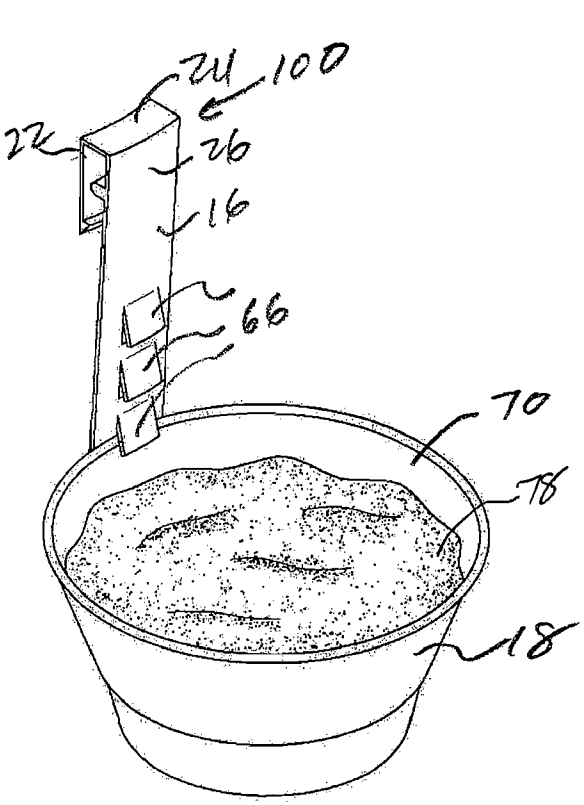
FIG. 21 is an isometric view of an alternate embodiment of a hanging condiment container holder according to the present invention with a plurality of condiment container securing tabs, with a condiment container inserted into the hanging condiment container holder.
Figure 20:
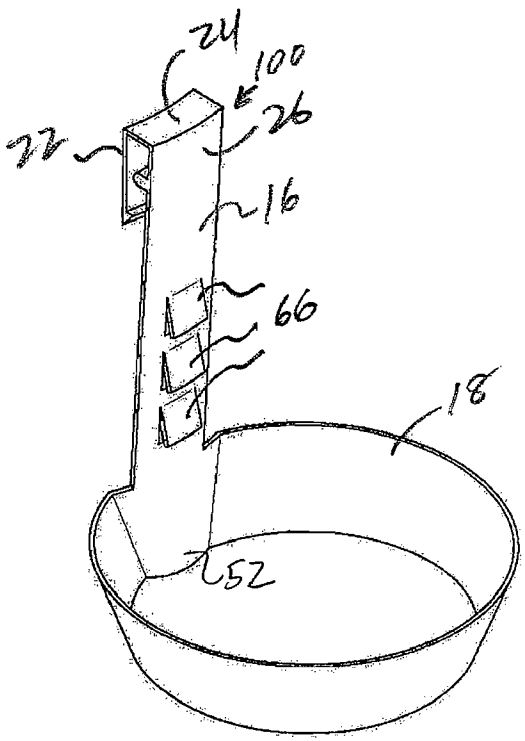
FIG. 20 is an isometric view of an alternate embodiment of a hanging condiment container holder according to the present invention with a plurality of condiment container securing tabs.
Figure 19:
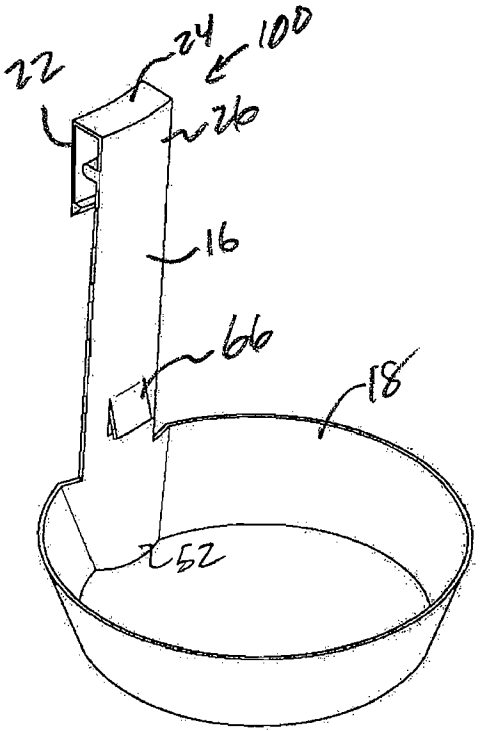
FIG. 19 is an isometric view of an alternate embodiment of a hanging condiment container holder according to the present invention with a condiment container securing tab.
Figure 23:
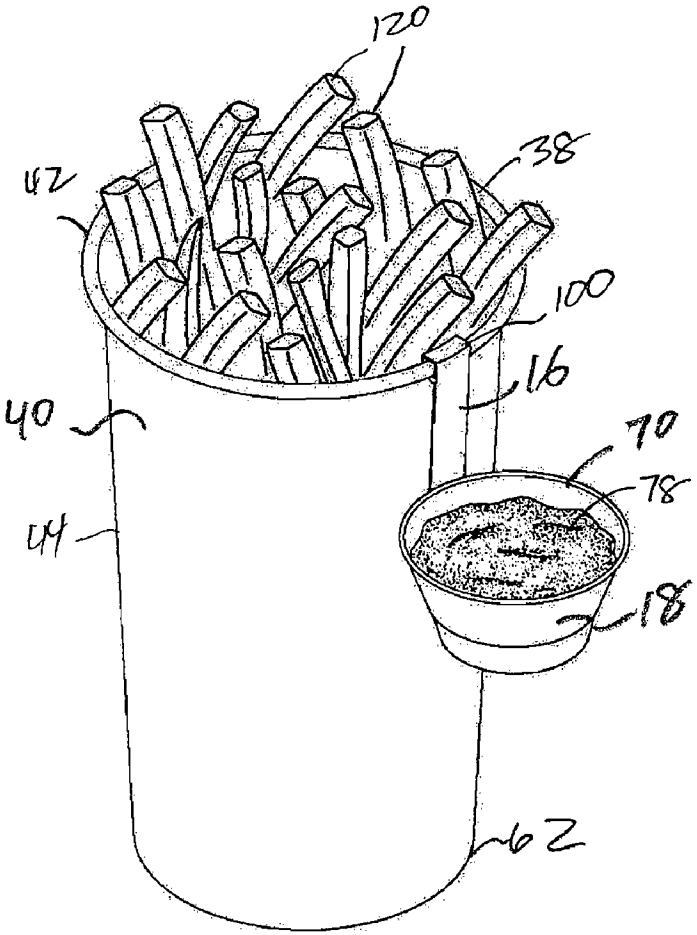
FIG. 23 is an isometric view of a hanging condiment container holder according to the present invention suspended from the upper portion of a food container with a condiment container inserted into the hanging condiment container holder.
Figure 22:
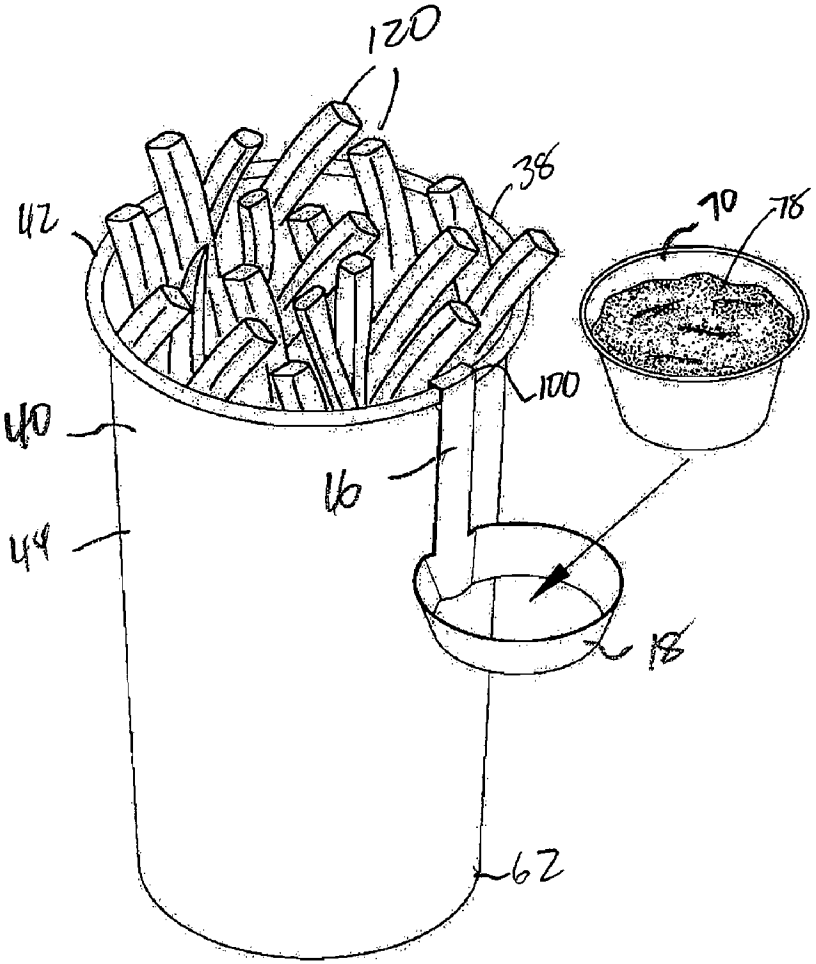
FIG. 22 is an isometric view of a hanging condiment container holder according to the present invention suspended from the upper portion of a food container, and a condiment container to be inserted into the hanging condiment container holder.

FIGS. 19-21 show the embodiment of a hanging condiment holder of the present invention shown in FIG. 16 including retaining tabs 66, which will function to assist in holding a condiment container 70 in the loop 18. FIGS. 22-23 show the embodiment of a hanging condiment holder of the present invention shown in FIG. 16 suspended from a cup 40, with a condiment container 70 positioned for insertion into the loop 18.

The extension wall 16 of the holder 10 may have any length, and may be of a length so that when the holder 10 is attached to a food package such as a cup 40, the loop portion will be positioned corresponding generally to the center of gravity of the cup 40, either when the cup is empty, or when the cup is full of a food product. This will provide for an arrangement that is less likely to tip the cup over when a condiment container 70 is placed in the loop 18.

In addition, one or a plurality of gripping studs 112 may be position on the inner wall of the loop 18. Such studs 112 may assist in holding a condiment cup 70 within the loop 18.

Because the hanging condiment container holder of the present invention does not directly hold any condiments (condiments are held in the condiment container placed in the loop portion), the hanging condiment container holder of the present invention can be reused. In addition, the hanging condiment container holder of the present invention will not be dirtied by the condiment. Any condiment container such as a soufflé cup placed in the loop portion is easily disposed of.

It is appreciated that various arrangements of a hanging holder for a condiment container can be created by selecting from and combining various elements of the various embodiments shown and described herein.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiments are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to the embodiments which come within the meaning and range of equivalency of said claims are therefore to be embraced therein.

What is claimed is:

1. A hanging condiment container holder for hanging a condiment container on an outer surface of a food package, comprising:

a clip portion for removably attaching the holder to an upper portion of a food package;

a loop portion for receiving a condiment container, a portion of the loop portion being curved towards a center of the loop portion; and, an extension wall extending between the clip portion and the loop portion, the extension wall comprising at least one integrally formed flexible retaining tab adapted to engage a condiment container placed in the loop portion.

2. The hanging condiment container holder of claim 1, wherein the food package is a cup having a lip formed adjacent its upper edge, and wherein the clip portion comprises a contoured lip engaging portion shaped to engage the lip portion of the cup.

3. The hanging condiment container holder of claim 1, wherein the loop portion and the extension wall are disposed at an angle relative to each other so that the loop portion is positioned generally horizontal when the hanging condiment container holder is attached to the upper edge of a food container.

4. The hanging condiment container holder of claim 1, wherein the food package is a cup having a rounded lip formed adjacent its upper edge, and wherein the clip portion is rounded having a contour shaped complimentary to the lip.

5. The hanging condiment container holder of claim 1, wherein the food package is a cup having a lip formed adjacent its upper edge, and wherein the clip portion comprises: a clip wall positioned opposite an upper portion of the extension wall, and a means for biasing the clip wall toward the upper portion of the extension wall.

6. The hanging condiment container holder of claim 1, wherein the extension wall has a length whereby the loop portion will not be directly adjacent the upper edge of a food package when the hanging condiment container holder is suspended from the upper edge of the food package.

7. The hanging condiment container holder of claim 1, wherein the condiment container is arranged within the loop portion and supported at least in part by an inner surface of the loop portion.

8. The hanging condiment container holder of claim 1, wherein the condiment container is arranged within the loop portion such that a bottom portion of the condiment container extends below the loop portion.

9. A hanging condiment container holder, for hanging a condiment container on an outer surface of a food package, comprising:

a clip portion for removably attaching the holder to an upper portion of a food package;

a loop portion for receiving a condiment container; and an extension wall extending between the clip portion and the loop portion, the extension wall comprising a plurality of integrally formed flexible retaining tabs adapted to engage a condiment container placed in the loop portion.

10. The hanging condiment container holder of claim 9, wherein each of the plurality of integrally formed flexible retaining tabs is arranged on the extension wall at a predetermined distance from the loop portion to engage a condiment container of a particular size.

* * * * *